US008864873B2

(12) United States Patent
Chen et al.

(10) Patent No.: US 8,864,873 B2
(45) Date of Patent: Oct. 21, 2014

(54) METHOD FOR PREPARING SPONGE TITANIUM FROM POTASSIUM FLUOTITANATE BY ALUMINOTHERMIC REDUCTION

(75) Inventors: Xuemin Chen, Guangdong (CN); Jun Yang, Guangdong (CN); Zhi Zhou, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 147 days.

(21) Appl. No.: 13/585,721

(22) Filed: Aug. 14, 2012

(65) Prior Publication Data

US 2012/0304823 A1 Dec. 6, 2012

(30) Foreign Application Priority Data

Jan. 18, 2012 (CN) ..... 2012 1 0014931

(51) Int. Cl.
*C22B 34/00* (2006.01)
*C22B 34/12* (2006.01)

(52) U.S. Cl.
CPC ..... *C22B 34/1277* (2013.01)
USPC ..... 75/615; 75/620

(58) Field of Classification Search
CPC C22B 34/1222; C22B 3/1231; C22B 3/1268; C22B 3/1277
USPC ..... 75/615, 620
See application file for complete search history.

(56) References Cited

U.S. PATENT DOCUMENTS 4,390,365 A * 6/1983 Hard et al. ..... 75/419

* cited by examiner

*Primary Examiner* — George Wyszomierski
*Assistant Examiner* — Tina M McGuthry Banks
(74) *Attorney, Agent, or Firm* — Jackson IPG PLLC

(57) ABSTRACT

The invention provides a method for preparing sponge titanium from potassium fluotitanate by aluminothermic reduction, comprising the following steps: a reaction step: aluminum and zinc are mixed under a vacuum state, and the mixture is then reacted with potassium fluotitanate; a distillation step: KF, $AlF_3$ and Zn generated by reaction are distilled out under a vacuum state; and a cooling step: sponge titanium is obtained subsequent to banking cooling. The invention further provides another method for preparing sponge titanium from potassium fluotitanate by aluminothermic reduction, comprising the following steps: a reaction step: aluminum and magnesium are mixed under a vacuum argon introduction condition, and the mixture is then reacted with potassium fluotitanate; a distillation step: KF, $AlF_3$, $MgF_2$ and Mg generated by reaction are distilled out under a vacuum state; and a cooling step: sponge titanium is obtained subsequent to banking cooling.

15 Claims, No Drawings

METHOD FOR PREPARING SPONGE TITANIUM FROM POTASSIUM FLUOTITANATE BY ALUMINOTHERMIC REDUCTION

TECHNICAL FIELD OF THE INVENTION

The invention relates to a method for preparing sponge titanium from potassium fluotitanate by aluminothermic reduction, more particularly to a method for preparing sponge titanium from potassium fluotitanate by aluminothermic reduction, which has the advantages of low cost, high efficiency and continuous operation.

BACKGROUND OF THE INVENTION

The sponge titanium production processes that have been well-known domestically and overseas mainly include: metallothermic reduction process, electrolysis process, direct thermolysis process and electronically mediated reaction process, etc., and the typical raw materials include titanium chloride ($TiCl_4$, $TiI_4$), titanium oxide ($TiO_2$) and titanium compounds ($K_2TiF_6$, $Na_2TiF_6$). Among various sponge titanium production processes, the traditional titanium tetrachloride aluminum-magnesium thermal reduction method (Kroll method), though mature and industrialized, has complex process and high cost and is pollutant to environment, thus limiting its further application and popularization. The method for preparing sponge titanium from potassium fluotitanate by metallothermic reduction process is a production method which is continuous, low in cost and high in efficiency and can settle plenty of problems in the traditional process efficiently, however, there are only a few domestic and overseas reports, and so far, a successful industrialization case has not been found yet.

SUMMARY OF THE INVENTION

To solve the technical problems above, the invention provides a method for preparing sponge titanium from potassium fluotitanate by aluminothermic reduction, comprising the following steps:

a reaction step: aluminum and zinc are mixed under a vacuum state, and the mixture is then reacted with potassium fluotitanate;

a distillation step: KF, $AlF_3$ and Zn generated by reaction are distilled out under a vacuum state; and a cooling step: sponge titanium is obtained subsequent to banking cooling;

wherein the mass ratio of the aluminum to the zinc is 1:2 to 1:10.

Preferably, the reaction temperature in the reaction step is 800° C.

Preferably, the distillation temperature in the distillation step is 1000° C.

The invention further provides a method for preparing sponge titanium from potassium fluotitanate by aluminothermic reduction, comprising the following steps:

a reaction step: aluminum and magnesium are mixed under a vacuum argon introduction condition, and the mixture is then reacted with potassium fluotitanate;

a distillation step: KF, $AlF_3$, $MgF_2$ and Mg generated by reaction are distilled out under a vacuum state;

and a cooling step: sponge titanium is obtained subsequent to banking cooling;

wherein the mass ratio of the aluminum to the magnesium is 1:1 to 1:10.

Preferably, the reaction temperature in the reaction step is 750° C.

Preferably, the distillation temperature in the distillation step is 1100° C.

The invention further provides a method for preparing sponge titanium from potassium fluotitanate by aluminothermic reduction, comprising the following steps:

a reaction step: aluminum, magnesium and zinc are mixed under a vacuum argon introduction condition, and the mixture is then reacted with potassium fluotitanate;

a distillation step: KF, $AlF_3$, $MgF_2$, Mg and Zn generated by reaction are distilled out under a vacuum state;

and a cooling step: sponge titanium is obtained subsequent to banking cooling;

wherein the mass ratio of the aluminum to the zinc to the aluminum is 2:8:0.1 to 1:4:1.

Preferably, the reaction temperature in the reaction step is 800° C.

Preferably, the distillation temperature in the distillation step is 1000° C.

Preferably, the cooling time in the cooling step is 10 hours.

Preferably, the cooling rate in the cooling step is 1° C./min.

The invention has the advantages that: by adopting the technical proposal discussed above, the method is short in technological flow, low in cost, harmless and environment-friendly compared with traditional processes, and rivals the prior art for the reduction rate and yield of sponge titanium, furthermore, the final resultant sponge titanium can be directly applied to technological production, further saving resources and cost.

DETAILED DESCRIPTION OF THE PREFERRED EMBODIMENTS

The preferred embodiments of the invention will be described below in further details:

Proposal 1: method for preparing titanium from potassium fluotitanate by aluminothermic reduction process based on zinc matrix:

The equation related is as follows:

$$3K_2TiF_6+4Al=3Ti+6KF+4AlF_3$$

Embodiment 1

36 g aluminum and 72 g zinc are mixed under a vacuum state, and the mixture is then reacted with 240 g potassium fluotitanate at 800° C.;

KF, $AlF_3$ and Zn generated by the above reaction are distilled out at 1000° C. under a vacuum state;

while the vacuum state is kept, the product is subjected to banking cooling at the cooling rate of 1° C./min for 10 hours to obtain 54.01 g sponge titanium; in the product, the titanium content is 73.4% and the reduction rate is 82.6%.

Embodiment 2

36 g aluminum and 144 g zinc are mixed under a vacuum state, and the mixture is then reacted with 240 g potassium fluotitanate at 800° C.;

KF, $AlF_3$ and Zn generated by the above reaction are distilled out at 1000° C. under a vacuum state;

while the vacuum state is kept, the product is subjected to banking cooling at the cooling rate of 1° C./min for 10 hours to obtain 50.22 g sponge titanium; in the product, the titanium content is 90.8% and the reduction rate is 95%.

Embodiment 3

36 g aluminum and 216 g zinc are mixed under a vacuum state, and the mixture is then reacted with 240 g potassium fluotitanate at 800° C.;

KF, $AlF_3$ and Zn generated by the above reaction are distilled out at 1000° C. under a vacuum state;

while the vacuum state is kept, the product is subjected to banking cooling at the cooling rate of 1° C./min for 10 hours to obtain 59.4 g sponge titanium; in the product, the titanium content is 70.7% and the reduction rate is 87.5%.

Embodiment 4

40 g aluminum and 160 g zinc are mixed under a vacuum state, and the mixture is then reacted with 240 g potassium fluotitanate at 800° C.;

KF, $AlF_3$ and Zn generated by the above reaction are distilled out at 1000° C. under a vacuum state;

while the vacuum state is kept, the product is subjected to banking cooling at the cooling rate of 1° C./min for 10 hours to obtain 48.39 g sponge titanium; in the product, the titanium content is 97% and the reduction rate is 97.8%.

Embodiment 5

44 g aluminum and 176 g zinc are mixed under a vacuum state, and the mixture is then reacted with 240 g potassium fluotitanate at 800° C.;

KF, $AlF_3$ and Zn generated by the above reaction are distilled out at 1000° C. under a vacuum state;

while the vacuum state is kept, the product is subjected to banking cooling at the cooling rate of 1° C./min for 10 hours to obtain 48.29 g sponge titanium; in the product, the titanium content is 98.6% and the reduction rate is 99.2%.

TABLE 1

Distillation Test Data

| Embodiment | Addition Amount of Raw Materials, g | | | Theoretical Amount of Ti, g | Actual Sponge Titanium Product, g | Ti Content In Product, % | Reduction Rate, % |
|---|---|---|---|---|---|---|---|
| | $K_2TiF_6$ | Al | Zn | | | | |
| 1 | 240 | 36 | 72 | 48 | 54.01 | 73.4 | 82.6 |
| 2 | 240 | 36 | 144 | 48 | 50.22 | 90.8 | 95 |
| 3 | 240 | 36 | 216 | 48 | 59.4 | 70.7 | 87.5 |
| 4 | 240 | 40 | 160 | 48 | 48.39 | 97 | 97.8 |
| 5 | 240 | 44 | 176 | 48 | 48.29 | 98.6 | 99.2 |

Reduction Rate (%)=(Actual Sponge Titanium Product×Ti Content In Product)/Theoretical Amount of Ti Proposal 2: method for preparing titanium from potassium fluotitanate by aluminum-magnesium thermal reduction process:

The equations related are as follows:

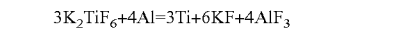

$$3K_2TiF_6+4Al=3Ti+6KF+4AlF_3$$

$$K_2TiF_6+2Mg=Ti+2MgF_2+2KF$$

Embodiment 6

36 g aluminum and 21.5 g magnesium are mixed under a vacuum argon introduction condition, and the mixture is then reacted with 240 g potassium fluotitanate at 750° C.;

KF, $AlF_3$, $MgF_2$ and Mg generated by reaction are distilled out at 1100° C. under a vacuum state;

while the vacuum state is kept, the product is subjected to banking cooling at the cooling rate of 1° C./min for 10 hours to obtain 48.93 g sponge titanium; in the product, the titanium content is 87.5% and the reduction rate is 89.2%.

Embodiment 7

36 g aluminum and 14.5 g magnesium are mixed under a vacuum argon introduction condition, and the mixture is then reacted with 240 g potassium fluotitanate at 750° C.;

KF, $AlF_3$, $MgF_2$ and Mg generated by reaction are distilled out at 1100° C. under a vacuum state;

while the vacuum state is kept, the product is subjected to banking cooling at the cooling rate of 1° C./min for 10 hours to obtain 47.79 g sponge titanium; in the product, the titanium content is 92.5% and the reduction rate is 92.1%.

Embodiment 8

36 g aluminum and 7 g magnesium are mixed under a vacuum argon introduction condition, and the mixture is then reacted with 240 g potassium fluotitanate at 750° C.;

KF, $AlF_3$, $MgF_2$ and Mg generated by reaction are distilled out at 1100° C. under a vacuum state;

while the vacuum state is kept, the product is subjected to banking cooling at the cooling rate of 1° C./min for 10 hours to obtain 47.56 g sponge titanium; in the product, the titanium content is 99.2% and the reduction rate is 98.3%.

Embodiment 9

36 g aluminum and 3.5 g magnesium are mixed under a vacuum argon introduction condition, and the mixture is then reacted with 240 g potassium fluotitanate at 750° C.;

KF, $AlF_3$, $MgF_2$ and Mg generated by reaction are distilled out at 1100° C. under a vacuum state;

while the vacuum state is kept, the product is subjected to banking cooling at the cooling rate of 1° C./min for 10 hours to obtain 50.67 g sponge titanium; in the product, the titanium content is 91.6% and the reduction rate is 96.7%.

TABLE 2

Distillation Test Data

| Embodiment | Addition Amount of | | | Theoretical Amount of Ti, g | Actual Sponge Titanium Product, g | Ti Content In Product, % | Reduction Rate, % |
|---|---|---|---|---|---|---|---|
| | $K_2TiF_6$ | Al | Mg | | | | |
| 6 | 240 | 36 | 21.5 | 48 | 48.93 | 87.5 | 89.2 |
| 7 | 240 | 36 | 14.5 | 48 | 47.79 | 92.5 | 92.1 |
| 8 | 240 | 36 | 7 | 48 | 47.56 | 99.2 | 98.3 |
| 9 | 240 | 36 | 3.5 | 48 | 50.67 | 91.6 | 96.7 |

Proposal 3: method for preparing titanium from potassium fluotitanate by aluminum-magnesium thermal reduction process based on zinc matrix:

The equations related are as follows:

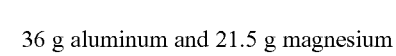

$$3K_2TiF_6+4Al=3Ti+6KF+4AlF_3$$

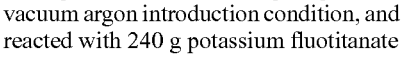

$$K_2TiF_6+2Mg=Ti+2MgF_2+2KF$$

Embodiment 10

36 g aluminum, 36 g magnesium and 144 g zinc are mixed under a vacuum argon introduction condition, and the mixture is then reacted with 240 g potassium fluotitanate at 800° C.;

KF, $AlF_3$, $MgF_2$, Mg and Zn generated by reaction are distilled out at 1100° C. under a vacuum state;

while the vacuum state is kept, the product is subjected to banking cooling at the cooling rate of 1° C./min for 10 hours to obtain 45.12 g sponge titanium; in the product, the titanium content is 96.5% and the reduction rate is 90.7%.

Embodiment 11

36 g aluminum, 18 g magnesium and 144 g zinc are mixed under a vacuum argon introduction condition, and the mixture is then reacted with 240 g potassium fluotitanate at 800° C.;

KF, $AlF_3$, $MgF_2$, Mg and Zn generated by reaction are distilled out at 1100° C. under a vacuum state;

while the vacuum state is kept, the product is subjected to banking cooling at the cooling rate of 1° C./min for 10 hours to obtain 45.45 g sponge titanium; in the product, the titanium content is 98% and the reduction rate is 92.8%.

Embodiment 12

36 g aluminum, 9 g magnesium and 144 g zinc are mixed under a vacuum argon introduction condition, and the mixture is then reacted with 240 g potassium fluotitanate at 800° C.;

KF, $AlF_3$, $MgF_2$, Mg and Zn generated by reaction are distilled out at 1100° C. under a vacuum state;

while the vacuum state is kept, the product is subjected to banking cooling at the cooling rate of 1° C./min for 10 hours to obtain 47.9 g sponge titanium; in the product, the titanium content is 99.5% and the reduction rate is 99.3%.

Embodiment 13

36 g aluminum, 2 g magnesium and 144 g zinc are mixed under a vacuum argon introduction condition, and the mixture is then reacted with 240 g potassium fluotitanate at 800° C.;

KF, $AlF_3$, $MgF_2$, Mg and Zn generated by reaction are distilled out at 1100° C. under a vacuum state;

while the vacuum state is kept, the product is subjected to banking cooling at the cooling rate of 1° C./min for 10 hours to obtain 48.29 g sponge titanium; in the product, the titanium content is 98.9% and the reduction rate is 99.5%.

TABLE 3

Distillation Test Data

| Embodiment | Addition Amount of Raw Materials, g | | | | Theoretical Amount of Ti, g | Actual Sponge Titanium Product, g | Ti Content In Product, % | Reduction Rate, % |
|---|---|---|---|---|---|---|---|---|
| | $K_2TiF_6$ | Al | Zn | Mg | | | | |
| 10 | 240 | 36 | 144 | 36 | 48 | 45.12 | 96.5 | 90.7 |
| 11 | 240 | 36 | 144 | 18 | 48 | 45.45 | 98 | 92.8 |
| 12 | 240 | 36 | 144 | 9 | 48 | 47.9 | 99.5 | 99.3 |
| 13 | 240 | 36 | 144 | 2 | 48 | 48.29 | 98.9 | 99.5 |

Further detailed descriptions are made to the invention with reference to the preferred embodiments in the above discussions and it could not be considered that the embodiments of the invention are limited to these descriptions only. Many simple derivations or alternations could be made without departing from the concept of the invention by ordinary skilled in this art to which the invention pertains, and shall be contemplated as being within the scope of the invention.

What is claimed is:

1. A method for preparing sponge titanium from potassium fluotitanate by aluminothermic reduction, characterized in that, the method comprises the following steps:

a reaction step: aluminum and zinc are mixed under a vacuum state to form a mixture, and the mixture is then reacted with potassium fluotitanate;

a distillation step: KF, $AlF_3$ and Zn generated by reaction are distilled out under a vacuum state; and a cooling step: sponge titanium is obtained subsequent to banking cooling;

wherein a mass ratio of the aluminum to the zinc is 1:2 to 1:10.

2. The method for preparing sponge titanium according to claim 1, wherein a reaction temperature in the reaction step is 800° C.

3. The method for preparing sponge titanium according to claim 1, wherein a distillation temperature in the distillation step is 1000° C.

4. The method for preparing sponge titanium according to claim 1, wherein a cooling time in the cooling step is 10 hours.

5. The method for preparing sponge titanium according to claim 4, wherein a cooling rate in the cooling step is 1° C./min.

6. A method for preparing sponge titanium from potassium fluotitanate by aluminothermic reduction, characterized in that, the method comprises the following steps:

a reaction step: aluminum and magnesium are mixed under a vacuum argon introduction condition to form a mixture, and the mixture is then reacted with potassium fluotitanate;

a distillation step: KF, $AlF_3$, $MgF_2$ and Mg generated by reaction are distilled out under a vacuum state; and a cooling step: sponge titanium is obtained subsequent to banking cooling;

wherein a mass ratio of the aluminum to the magnesium is 1:1 to 1:10.

7. The method for preparing sponge titanium according to claim 6, wherein a reaction temperature in the reaction step is 750° C.

8. The method for preparing sponge titanium according to claim 6, wherein a distillation temperature in the distillation step is 1100° C.

9. The method for preparing sponge titanium according to claim 6, wherein a cooling time in the cooling step is 10 hours.

10. The method for preparing sponge titanium according to claim 9, wherein a cooling rate in the cooling step is 1° C./min.

11. A method for preparing sponge titanium from potassium fluotitanate by aluminothermic reduction, characterized in that, the method comprises the following steps:

a reaction step: aluminum, magnesium and zinc are mixed under a vacuum argon introduction condition to form a mixture, and the mixture is then reacted with potassium fluotitanate;

a distillation step: KF, $AlF_3$, $MgF_2$, Mg and Zn generated by reaction are distilled out under a vacuum state; and a cooling step: sponge titanium is obtained subsequent to banking cooling;

wherein a mass ratio of the aluminum to the zinc to the aluminum is 2:8:0.1 to 1:4:1.

12. The method for preparing sponge titanium according to claim 11, wherein a reaction temperature in the reaction step is 800° C.

13. The method for preparing sponge titanium according to claim 11, wherein a distillation temperature in the distillation step is 1100° C.

14. The method for preparing sponge titanium according to claim 11, wherein a cooling time in the cooling step is 10 hours.

15. The method for preparing sponge titanium according to claim 14, wherein a cooling rate in the cooling step is 1° C./min.

* * * * *